US010974413B2

(12) United States Patent
Webster

(10) Patent No.: US 10,974,413 B2
(45) Date of Patent: Apr. 13, 2021

(54) FEED ROLLS HAVING FLUTE ASSEMBLIES OF MATINGLY ENGAGEABLE MOUNTS AND FLUTE INSERT ELEMENTS

(71) Applicant: Webco Mill Supply Ltd., Hope (CA)

(72) Inventor: Brian Webster, Hope (CA)

(73) Assignee: Webco Mill Supply Ltd., Hope (CA)

( * ) Notice: Subject to any disclaimer, the term of this patent is extended or adjusted under 35 U.S.C. 154(b) by 337 days.

(21) Appl. No.: 15/486,222

(22) Filed: Apr. 12, 2017

(65) Prior Publication Data

US 2018/0297230 A1 Oct. 18, 2018

(51) Int. Cl.

| | |
|---|---|
| ***B27B 31/00*** | (2006.01) |
| ***B27C 1/12*** | (2006.01) |
| ***B27B 25/02*** | (2006.01) |
| ***B27L 1/10*** | (2006.01) |
| ***B27L 1/00*** | (2006.01) |

(52) U.S. Cl.

CPC ..... *B27B 31/003* (2013.01); *B27B 25/02* (2013.01); *B27C 1/12* (2013.01); *B27L 1/00* (2013.01); *B27L 1/10* (2013.01)

(58) Field of Classification Search

CPC ..... B27B 25/02; B27B 31/003; B27C 1/12; B27L 1/00; B27L 1/025; B27L 1/04; B27L 1/045; B27L 1/08; B27L 1/10; A01G 23/08; A01G 23/083; A01G 23/095; A01G 23/0955; B29C 2043/461; B29C 2043/464; E02D 3/0265; E01C 19/231; E01C 19/236; Y10T 29/49549

USPC ..... 144/242.1, 246.1, 248.2, 248.3, 248.5, 144/248.6, 248.7; 269/289 MR; 198/608, 624; 492/30–37, 60; 404/124, 404/128; 193/35 R

See application file for complete search history.

(56) References Cited

U.S. PATENT DOCUMENTS

| | | | | |
|---|---|---|---|---|
| 4,658,875 A * | 4/1987 | Grabovac | ..... | B27G 13/04 144/117.1 |
| 5,044,570 A * | 9/1991 | Montgomery, Sr. | ..... | B02C 18/186 144/230 |
| 5,944,078 A * | 8/1999 | Lindholm | ..... | B27B 25/02 144/208.1 |
| 5,950,945 A * | 9/1999 | Schaller | ..... | B02C 13/28 241/189.1 |
| 6,253,813 B1 * | 7/2001 | Kube | ..... | B27B 25/02 144/246.1 |

(Continued)

FOREIGN PATENT DOCUMENTS

| | | |
|---|---|---|
| CA | 2323903 | 3/2002 |
| EP | 1186388 | 3/2002 |

OTHER PUBLICATIONS

International Searching Authority, The International Search Report and the Written Opinion of the International Searching Authority, or the Declaration, International Application No. PCT/CA2018/050447, Filed Apr. 11, 2018, 10 pages, Receiving Office—Canadian Intellectual Property Office.

*Primary Examiner* — Shelley M Self
*Assistant Examiner* — Jared O Brown
(74) *Attorney, Agent, or Firm* — Oyen Wiggs Green & Mutala LLP

(57) ABSTRACT

The flute insert element further comprises the outer longitudinal edge being formed with a traction element and the plate body having a plurality of bolt holes therethrough for registering with the bolt holes of the mount element when the plate body and the seat are matingly engaged.

18 Claims, 8 Drawing Sheets

(56) References Cited

U.S. PATENT DOCUMENTS

| | | | | |
|---|---|---|---|---|
| 6,422,277 | B1 | 7/2002 | Kube et al. | |
| 6,764,035 | B2 * | 7/2004 | Denis | A01G 23/00 241/101.72 |
| 7,350,548 | B1 * | 4/2008 | Cholewczynski | B27L 1/08 144/208.4 |
| 7,565,921 | B2 * | 7/2009 | Roy | B27B 25/02 144/246.1 |
| 7,882,869 | B2 * | 2/2011 | Kube | B27B 25/02 144/208.1 |
| 8,186,611 | B1 * | 5/2012 | Boer | A23N 17/007 241/260.1 |
| 10,124,509 | B2 * | 11/2018 | Runquist | E01C 23/0933 |
| 2002/0062879 | A1 * | 5/2002 | Johnson | B27B 25/02 144/246.1 |
| 2003/0222164 | A1 * | 12/2003 | Denis | B02C 18/18 241/294 |
| 2008/0298909 | A1 * | 12/2008 | Gaudreault | B23C 5/2239 407/47 |
| 2010/0108195 | A1 * | 5/2010 | Durant | B27L 1/10 144/208.9 |
| 2010/0154932 | A1 * | 6/2010 | Cholewczynski | B27L 1/08 144/208.4 |
| 2016/0045962 | A1 * | 2/2016 | Tanaka | B23C 5/2278 407/46 |
| 2018/0050465 | A1 * | 2/2018 | Martin | B27B 25/02 |

* cited by examiner

FEED ROLLS HAVING FLUTE ASSEMBLIES OF MATINGLY ENGAGEABLE MOUNTS AND FLUTE INSERT ELEMENTS

BACKGROUND OF THE INVENTION

1. Field of Invention

The present invention relates generally to powered feed rolls of the type used, for example, in feeding and discharging logs to and from the barkers.

2. Description of Related Art

In lumber mills and other settings, logs are fed into and discharged from various machines that operate on the logs. A common arrangement for feeding and discharging logs has upper and lower spaced pairs of driven feed rolls. Each feed roll has generally cylindrical roll driven to rotate about its longitudinal axis. Flutes are arranged on the outer surface of the roll to cradle, grip and propel the logs tangentially to the rotation of the feed roll.

Flutes are located on the outer surface of the roll in circumferentially matched pairs, and are typically arranged symmetrically about a central cross-section of the feed roll perpendicular to and at the approximate center of the longitudinal axis of the feed roll. In a typical arrangement, the end of each flute nearest to the central cross-section is displaced circumferentially from its opposite end, such that the major axis of the flute forms an angle with the longitudinal axis of the roll. To provide a cradle for the logs, the complementing flutes taper toward the central cross-section of the roll (i.e., the radially outward extent of the flutes become closer to the feed roll's longitudinal axis) in a V-shaped configuration. The radially outward sides of the flutes are typically provided with a serrated configuration to improve traction with logs.

In operation, the radially outward sides of the flutes engage logs, and the V-shaped cradle configuration of the matched flute pairs works to center logs over the central cross-section of the roll. Feed rolls are often operated to propel logs at high speeds, and speeds as great as 10 linear feet per second are common. The result of this is that flutes are exposed to strong forces and wear. Due to the centering action of the V-shaped cradle configuration, flutes experience the greatest wear in their central section.

In the prior art, there are feed rolls whose flutes comprise replaceable flute inserts. In these feed rolls, the replaceable flute inserts are bolted in position to anchoring elements welded to the roll. An example of these is shown in U.S. Pat. No. 6,253,813B1. In these feed rolls, anchors are welded to the outer surface of the roll. Each anchor provides a side face that extends outwardly from the outer surface of the roll, and flute inserts are held in butting relation to the side face by bolts. The flute inserts are also configured so that at least part of their radially inner edge bears directly against the outer surface of the roll. The advantage of this configuration is that the side face supports the flute against forces tangential to the roll, and the bearing of the radially inner edges directly against the outer surface reduces the load on the bolts from force applied by logs to the radially outward sides of the flute inserts.

A potential disadvantage identified in the above-described replaceable flute feed rolls arises from the fact that in practice the bolt holes provided on the anchors are often made oblong in order that flute insert elements can be positioned to bear against the outer surface of the roll notwithstanding variations in the position of anchors relative to the outer surface of the roll (such as may be introduced in welding the anchors to the roll). In use, strong forces acting on the flute elements sometimes cause the bolts to slip relative to the anchors, with resulting outward displacement of the flute insert elements. This in turn may expose the displaced flute to even greater forces, and may result in damage to the flute insert element or the bolts that hold it to the anchor.

A further limitation of some prior art feed rolls is that the strong forces acting on the flute elements cause the flute elements to move relative to the outer surface of the roll. This causes friction and wear between the contacting surfaces of the flute elements and the roll.

The foregoing examples of the related art and limitations related thereto are intended to be illustrative and not exclusive. Other limitations of the related art will be apparent to those of skill in the art upon a reading of the specification and a study of the drawings.

The foregoing examples of the related art and limitations related thereto are intended to be illustrative and not exclusive. Other limitations of the related art will be apparent to those of skill in the art upon a reading of the specification and a study of the drawings.

SUMMARY OF THE INVENTION

According to a first embodiment of the present invention there is disclosed a feed roll comprising a roll having a rotary axis, two complementing sets of flutes fixed on the roll, two complementing sets of mounts fixed on the roll between the sets of flutes, each mount having a seat spaced apart from the outer surface of the roll and replaceable flute elements detachably and matingly engaged in the seats of respective mounts and extending outward beyond the mounts.

The mount may have a first face spaced outwardly apart from the outer surface of the roll and a second face outward of the first face, and the first and second faces define, at least in part, the seat. The seat may be defined, at least in part, by a first face of the mount spaced outwardly apart from the outer surface of the roll and a second face of the mount outward of the first face. Each mount may have a base portion adjacent to the outer surface of the roll and a back portion outward of the base portion, and the base portion and the backing portion define, at least in part, the seat.

The second face may extend outwardly from the first face. The first face and the second face may form an angle of 90 degrees or less. Each flute element may comprise an inner face that butts against the first face of a respective mount. Each mount may comprise an inner stop at an inner end thereof. The inner stop of each mount may comprise a beveled inner edge that is generally orthogonal to the rotary axis of the roll. Each mount may comprise an outer stop at an outer end thereof. The outer stop of each mount may be joined to an inner end of a respective flute.

The seat may be configured to support the replaceable flute elements against motion in a radially inward direction and against motion in a direction opposite rotation of the roll about the rotary axis. The seat may be configured to support the replaceable flute elements against motion in an axial direction of the roll.

A threaded hole defined through each flute element may be registered with a threaded hole of a respective mount, and wherein the thread of the hole through the flute element is matched to the thread of the hole through the mount. A threaded hole defined through each flute element may be registered with a threaded hole of a respective mount, and wherein the thread of the hole through the flute element is continuous with the thread of the hole through the mount.

According to a further embodiment of the present invention there is disclosed a feed roll comprising a cylindrical roll, complementing sets of outer flutes on the roll and spaced apart centrally of the roll, complementing sets of mounts fixed on the roll between the sets of outer flutes, each mount having a seat spaced apart from the outer surface of the roll and replaceable flute elements detachably and matingly engaged in the seats of respective mounts and continuing toward the longitudinal center of the roll from the outer flutes, the flute elements extending outward beyond the mounts.

Each mount may have a first face spaced outwardly apart from the outer surface of the roll and a second face outward of the first face, and the first and second faces define, at least in part, the seat. The seat may be defined, at least in part, by a first face of the mount spaced outwardly apart from the outer surface of the roll and a second face of the mount outward of the first face. Each mount may have a base portion adjacent to the outer surface of the roll and a back portion outward of the base portion, and the base portion and the backing portion define, at least in part, the seat. The second face may extend outwardly from the first face.

The first face and the second face may form an angle of 90 degrees or less. Each flute element may comprise an inner face that butts against the first face of a respective mount. Each mount may comprise an inner stop at an inner end thereof. The inner stop of each mount may comprise a beveled inner edge that is generally orthogonal to the rotary axis of the roll. Each mount may comprise an outer stop at an outer end thereof. The outer stop of each mount may be joined to an inner end of a respective flute.

The seat may be configured to support the replaceable flute elements against motion in a radially inward direction and against motion in a direction opposite rotation of the roll about the rotary axis. The seat may be configured to support the replaceable flute elements against motion in an axial direction of the roll. A threaded hole defined through each flute element may be registered with a threaded hole of a respective mount, and wherein the thread of the hole through the flute element is matched to the thread of the hole through the mount.

According to a further embodiment of the present invention there is disclosed a feed roll comprising a cylindrical roll having an internal hub flange for a drive connection and complementing outer sets of outer flute sections fixed on the outer surface of the roll and extending toward the longitudinal center of the roll from opposite ends of the roll, each of the outer flute sections having an inner end offset circumferentially of the roll from an outer end with respective flute sections in each outer set having their inner ends directly opposite one another and spaced apart equally from the longitudinal center. The feed roll further comprises complementing inner sets of mounts fixed on the outer surface of the roll and extending to the longitudinal center of the roll from the inner ends of the outer flute sections, the inner sets intersecting one another in a general V configuration at the longitudinal center, each mount having a seat spaced apart from the outer surface of the roll and replaceable sets of flute elements, detachably and matingly engaged in the seats of respective mounts, with each flute element extending outwardly beyond the mounts.

Each mount may have a first face spaced outwardly apart from the outer surface of the roll and a second face outward of the first face, and the first and second faces define, at least in part, the seat. The seat may be defined, at least in part, by a first face of the mount spaced outwardly apart from the outer surface of the roll and a second face of the mount outward of the first face.

Each mount may have a base portion adjacent to the outer surface of the roll and a back portion outward of the base portion, and the base portion and the backing portion define, at least in part, the seat. The base portion may constrain the flute element against motion in a first direction, the backing portion constrain the flute element against motion in a second direction that is orthogonal to the first direction. The first direction may be a radial direction of the roll. The second direction may be a rotational direction of the roll. The second direction may be tangential to the outer surface of the roll.

Each flute element may comprise an inner face that butts against the base portion of a respective mount. Each mount may comprise an inner stop at an inner end thereof. The inner stop of each mount may comprise a beveled inner edge that is generally orthogonal to the rotary axis of the roll. Each mount may comprise an outer stop at an outer end thereof. The outer stop of each mount may be joined to an inner end of a respective flute. A threaded hole defined through each flute element may be registered with a threaded hole of a respective mount, and wherein the thread of the hole through the flute element is matched to the thread of the hole through the mount.

According to a further embodiment of the present invention there is disclosed a replaceable flute insert element for use on a fluted roll having a mount element fixed in position and defining a seat with a set of bolt holes therethrough. The flute insert element comprises an elongated plate body having an inner longitudinal edge, an outer longitudinal edge, and a backing face extending between the inner longitudinal edge and the outer longitudinal edge and the inner longitudinal edge and the backing face configured to matingly engage the seat of the mount. The flue insert element further comprises the outer longitudinal edge being formed with a traction element and the plate body having a plurality of bolt holes therethrough for registering with the bolt holes of the mount element when the plate body and the seat are matingly engaged. The inner longitudinal edge may comprise a plurality of spaced apart recesses.

According to a further embodiment of the present invention there is disclosed a kit for retrofitting a feed roll comprising a set of complementing mounts, each mount having a base portion and a backing portion that together define a seat, the base portion having an arcuate face opposite and spaced apart from the seat and a set of complementing flute elements matingly engageable with the seats of mounts. The backing portion may be outward of the base portion.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Throughout the following description specific details are set forth in order to provide a more thorough understanding to persons skilled in the art. However, well known elements may not have been shown or described in detail in order to avoid unnecessarily obscuring the disclosure. Accordingly, the description and drawings are to be regarded in an illustrative, rather than a restrictive, sense.

Figure 1:
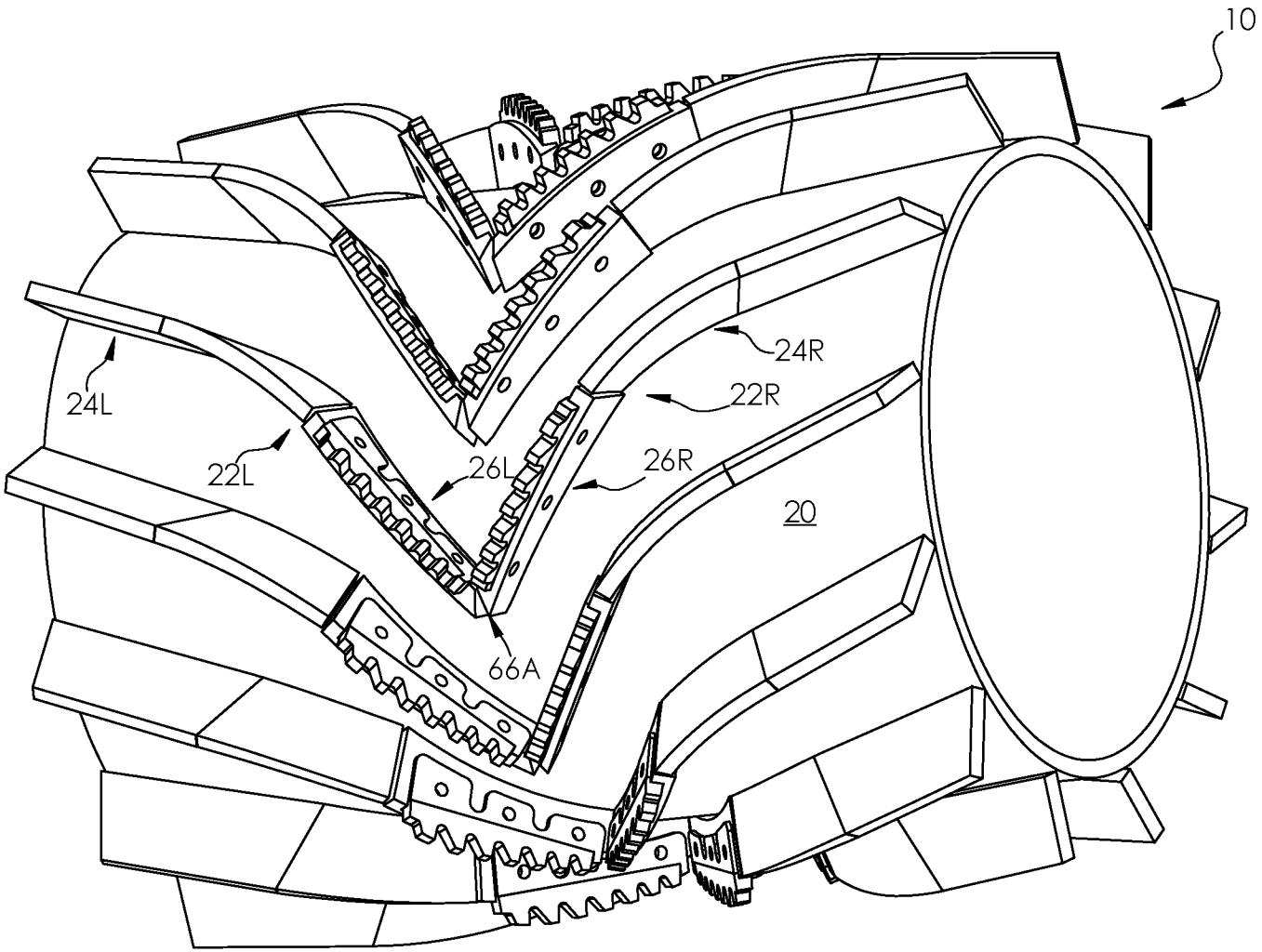
FIG. 1 is a perspective view of a feed roll according to an example embodiment.

FIG. 1 is a perspective view of a feed roll 10 according to an example embodiment. Feed roll 10 comprises a cylindrical body 20, which may consist of a length of steel pipe. Inside cylindrical body 20, and not visible in the drawings, is an annular flange provided with holes for receiving bolts to secure the flange to a driven hub. When driven, feed roll 10 rotates about its longitudinal axis.

The outer surface of body 20 is provided with left and right sets of complementing, circumferentially distributed flutes 22R-22L. The flutes each comprise fixed outer flutes 24R-24L, and inner flute assemblies 26R-26L. In the illustrated example, the feed roll 10 has 12 flutes in each right and left set which are equally spaced apart by 30°.

The outer flutes 24R-24L are mirror images of one another and are positioned so that their inner and outer ends are displaced with respect to one another circumferentially of the roll as seen, for example, in FIG. 1, and are welded in position. As can also be seen in FIG. 1 respective flute sections in each outer set have their inner ends directly opposite one another and are spaced apart equally from the longitudinal center of cylindrical body 20.

The flute assemblies 26R-26L are longitudinally between outer flutes 24R-24L, and are positioned so that their inner and outer ends are displaced with respect to one another circumferentially of the roll. Respective flute assemblies in each set have their inner ends directly opposite one another and are spaced apart equally from the longitudinal center of cylindrical body 20.

Figure 2:
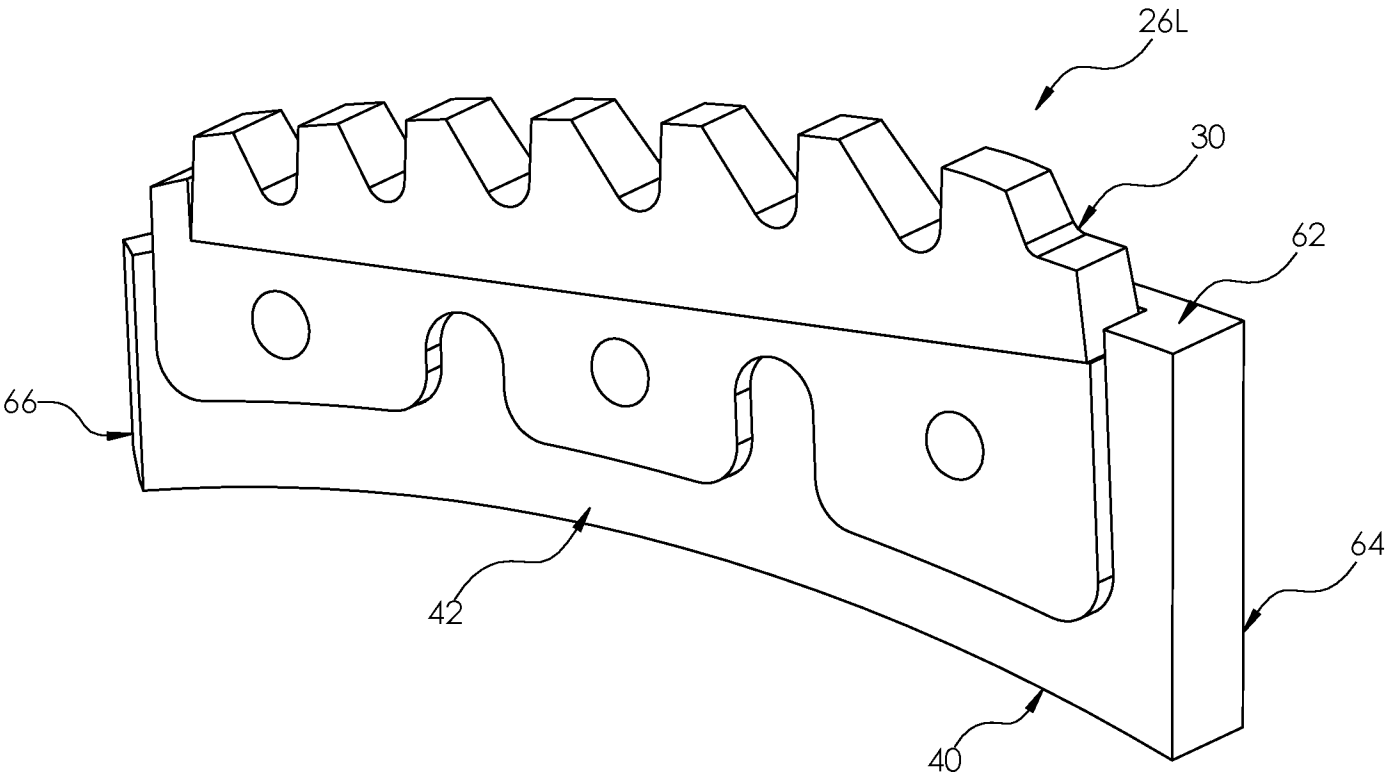
FIG. 2 is a perspective view of a flute assembly according to an example embodiment.
Figure 3A:
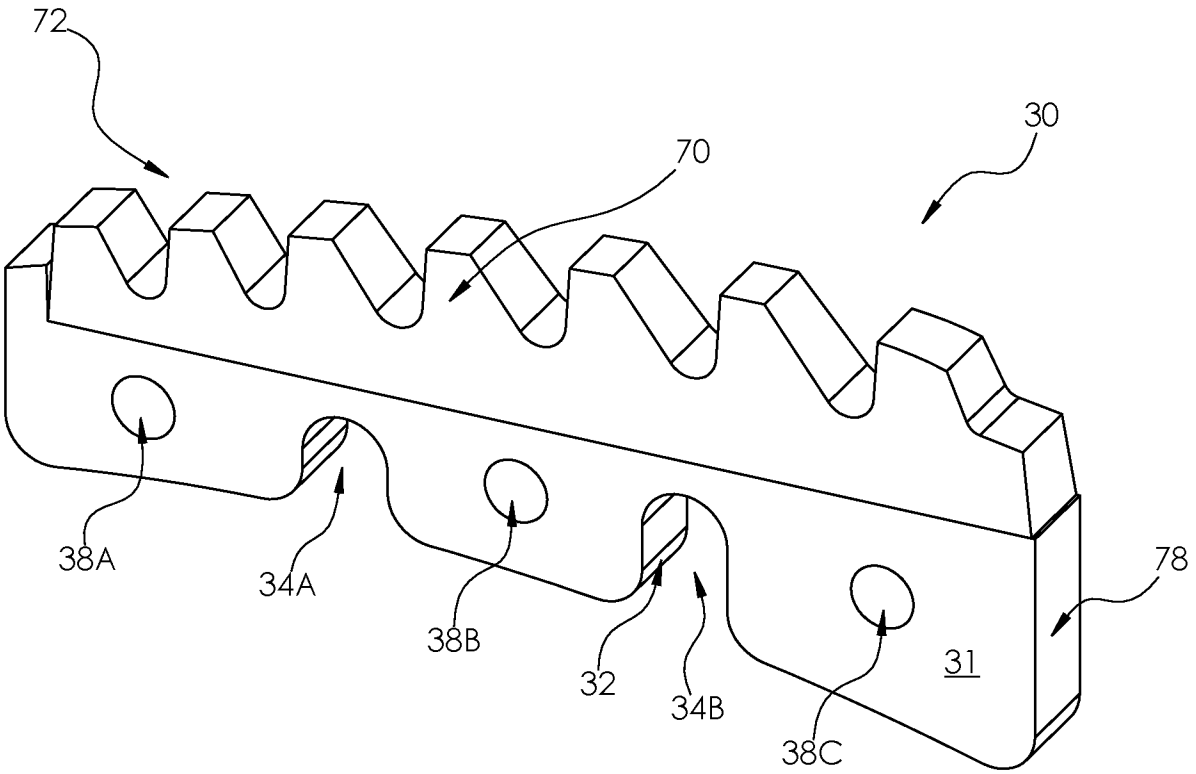
FIG. 3A is a perspective view of a flute insert element according to an example embodiment.
Figure 3B:
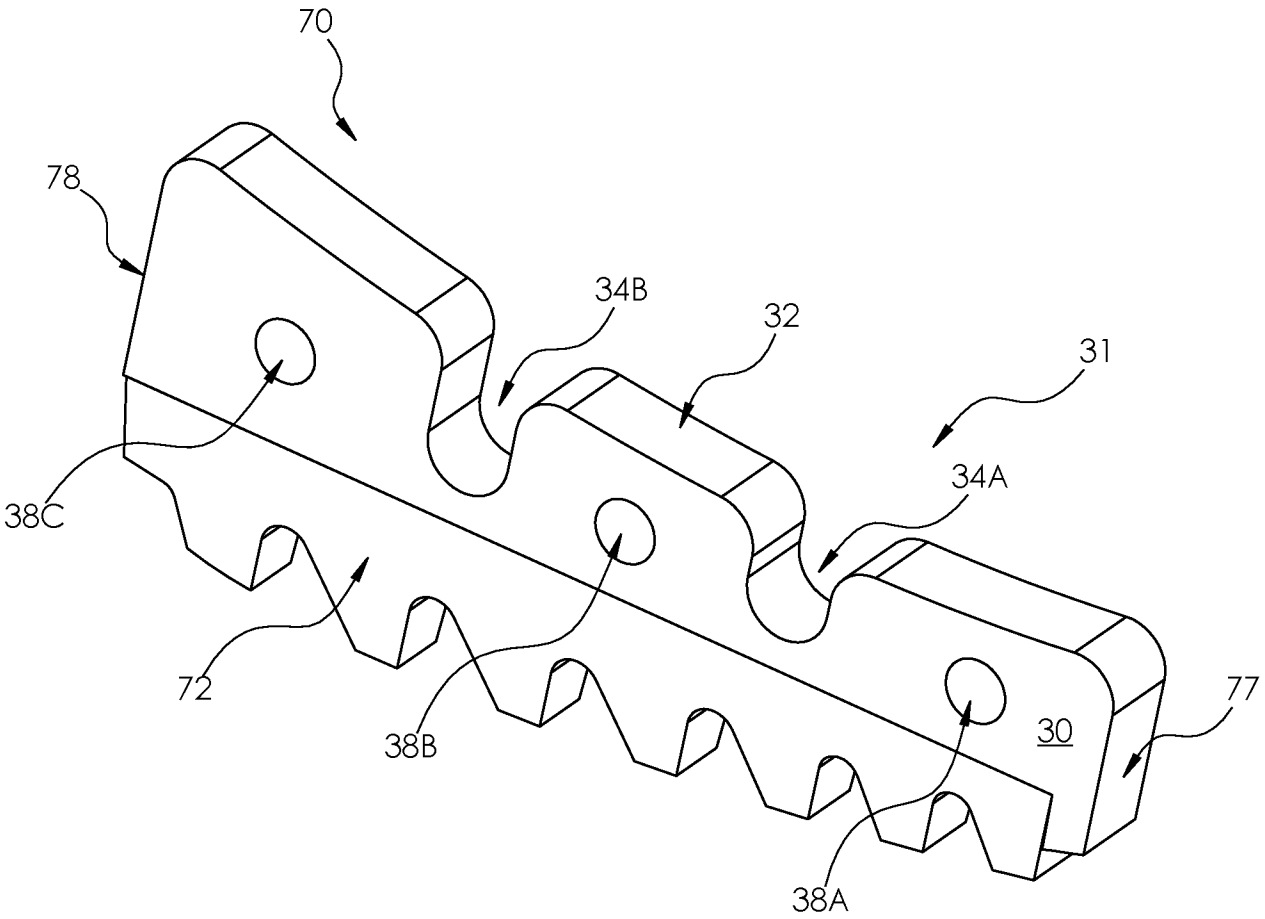
FIG. 3B is a different perspective view of the flute insert element shown in FIG. 3A.
Figure 4A:
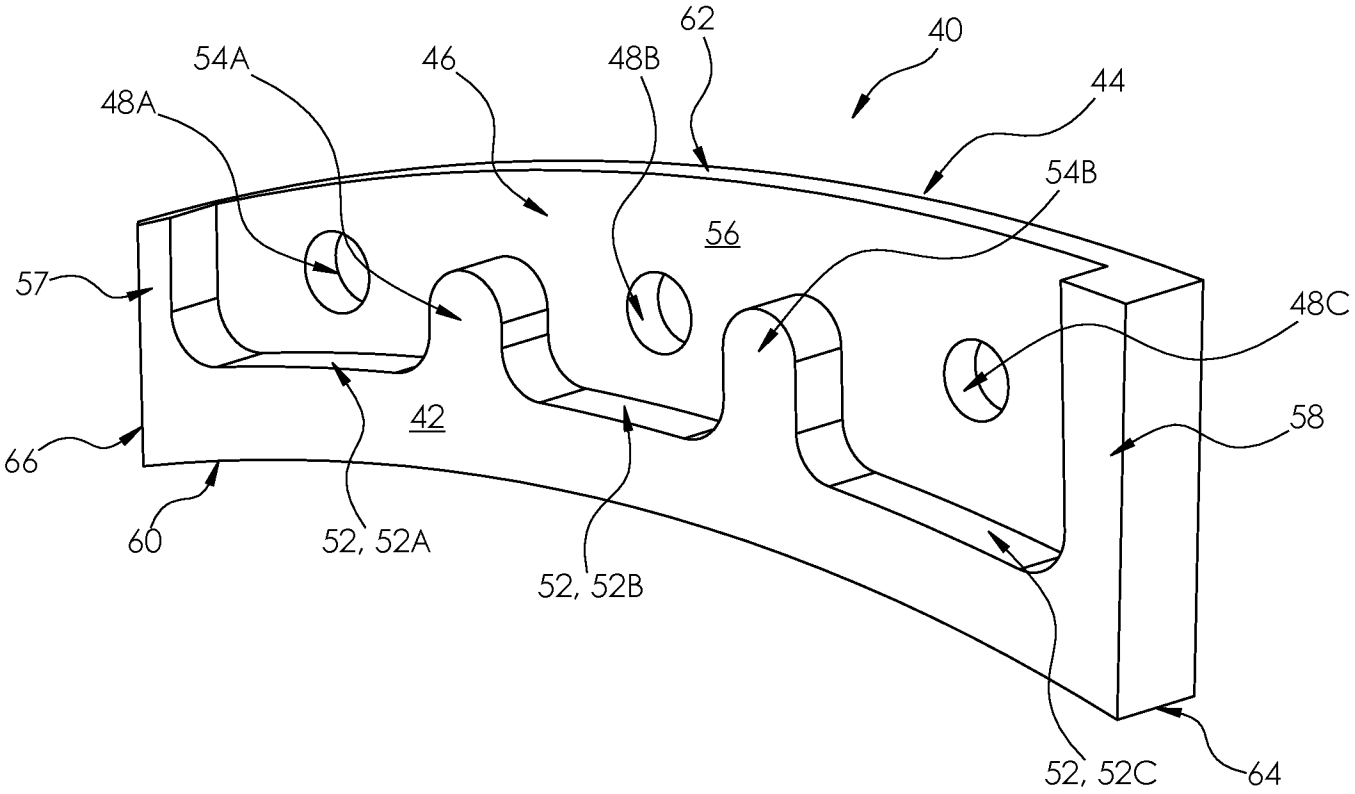
FIG. 4A is a perspective view of a mount according to an example embodiment.
Figure 4B:
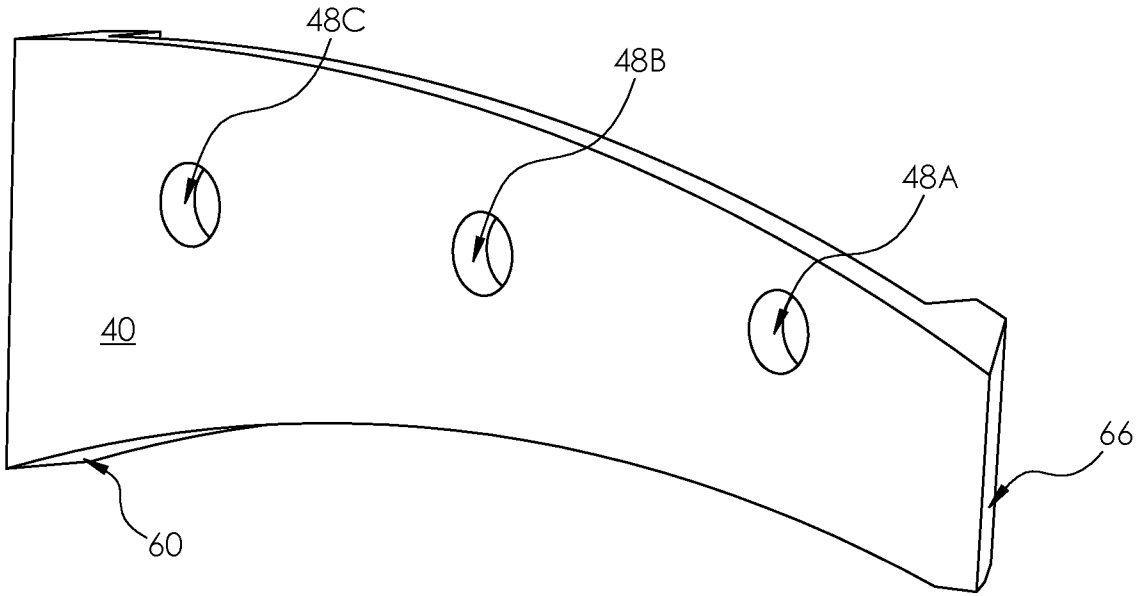
FIG. 4B is a different perspective view of the mount shown in FIG. 4A.
Figure 5:
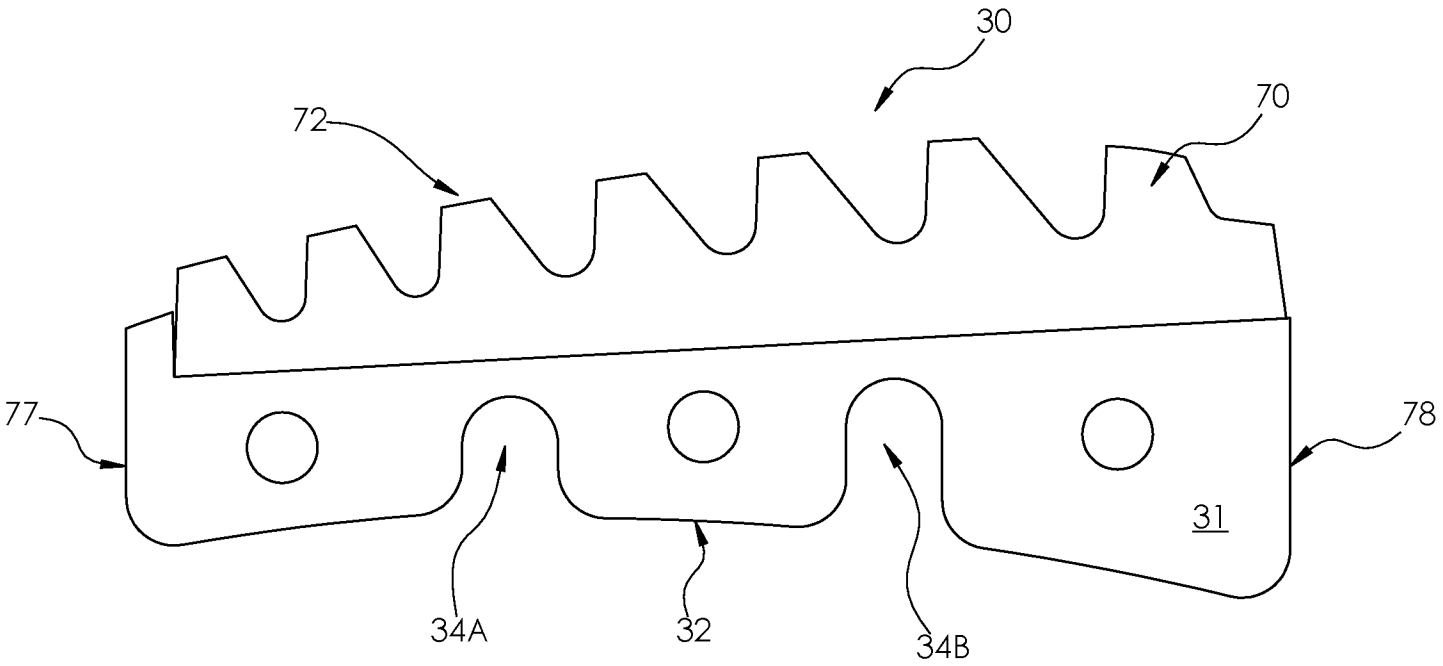
FIG. 5 is an elevation view of the flute insert element shown in FIG. 2.

FIG. 2 is an elevation view of flute assembly 26L, shown isolation. Flute assembly 26L comprises a flute element 30 seated in a mount 40. Features of flute assembly 26L are described below with reference to FIG. 2, and FIG. 3A and FIG. 3B, which show different perspective views of flute element 30, and FIG. 4A and FIG. 4B, which show different perspective views of mount 40, and also FIG. 5 and FIG. 6, which show elevation views of, respectively, flute element 30 and mount 40.

Mount 40 comprises a base portion 42 and a backing portion 44, located outward of base portion 42, that together define a seat 46. More specifically, base portion 42 has an outer face 52, which comprises face portions 52A, 52B and 52C separated by lugs 54A and 54B, which together with the adjoining mounting face 56 of backing portion 44 define seat 46. In the illustrated embodiment, outer face 52 of base portion 42 meets mounting face 56 of backing portion 44 at a 90 degree angle. In other embodiments, this angle between outer face 52 and mounting face 56 may be less than 90 degrees.

In the illustrated embodiment, mount 40 also comprises inner stop 57 and outer stop 58, both of which further define seat 46. Outer stop 58 is substantially the same width and depth as the inner end of the adjacent outer flute element 24L. Outer stop 58 may be joined to the inner end of outer flute element 24L, such as by welding, for example. A plurality of substantially equally spaced boreholes 48A, 48B and 48C are defined through backing portion 44 between inner stop 57 and outer stop 58. In some embodiments only a single borehole is provided through backing portion 44.

It will be observed that mount 40 has an arcuate inner edge 60 that is spaced apart from and radially inward of seat 46. More specifically, arcuate edge 60 is spaced apart from and generally opposite outer face 52 of base portion 42. As seen in FIG. 1, arcuate edge 60 abuts the outer surface of cylindrical body 20.

The arcuate configuration of edge 60 provides for close contact between base portion 42 of mount 40 and the outer surface of cylindrical body 20. The arcuate configuration of edge 60 also facilitates affixation, such as by welding, of mount 40 onto outer surface of cylindrical body 20. In some embodiments, edge 60 comprises a compound curve, which may facilitate continuous butting contact between base portion 42 of mount 40 and the outer surface of cylindrical body 20.

Figure 6:
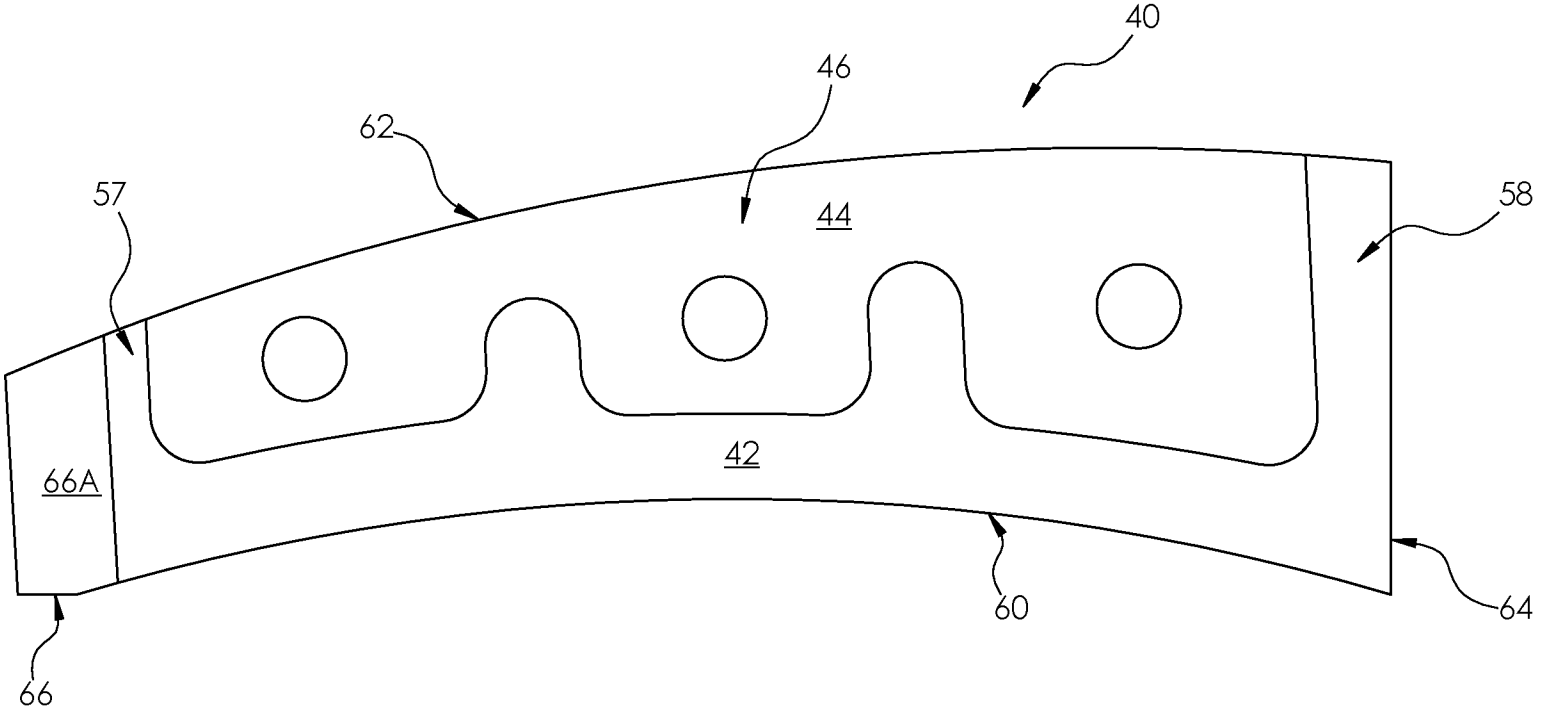
FIG. 6 is an elevation view of the mount shown in FIG. 2.

Arcuate inner edge 60 has a more inwardly located center and smaller radius than outer arcuate edge 62 of mount 40. As a result, mount 40 tapers from its outer end 64 to its inner end 66. As can be seen in FIG. 4 and FIG. 6, outer end 64 of mount 40 is wider ("higher" in FIG. 1) than inner end 66.

As best seen in FIG. 1, the inner end 66 of mount 40 is beveled to provide an inner edge 66A. The beveled inner edge 66A is relatively more closely aligned with the direction of rotational motion of feed roll 10 as compared with an edge perpendicular to the major axis of mount 40. In the illustrated embodiment, the beveled inner edge 66A is generally parallel to the cross-section of cylindrical body 20 (i.e., generally orthogonal to the rotary axis of feed roll 10), such that facing inner edges of complementing mounts are parallel to one another. This configuration facilitates a welded connection between the facing inner edges of complementing mounts on feed roll 10.

As shown in the drawings, flute element 30 comprises an elongated plate body 31 that is shaped for mating engagement with seat 46 of mount 40. In particular, body 31 comprises an inner face 32, which comprises three face portions separated by recesses 34A and 34B, and a backing face 36 that extends outwardly from inner face 32. Inner face 32 is complementary to outer face 52 of mount 40; more specifically, the curvature of inner face 32 matches the curvature of outer face 52. Backing face 36 is complementary to mounting face 56 of mount 40; more specifically, backing face 36 and mounting face 56 are both planar. Recesses 34A and 34B are formed on inner face 32 to receive lugs 54A and 54B of mount 40. Inner face 32 and backing face 36 form an angle that is complementary to the angle formed between outer face 52 and mounting face 56 that define seat 46. The described configuration provides for mating engagement of flute element 30 with seat 46 wherein inner face 32 abuts outer face 52 and backing face 34 abuts mounting face 56.

In the illustrated embodiment, plate body 31 has inner end 77 and outer end 78, and is dimensioned so that inner end 77 abuts inner stop 57 and outer end 78 abuts outer stop 58 when flute element 30 is matingly engaged with seat 46 of mount 40.

In the illustrated embodiment, the mating engagement of flute element 30 in seat 46 of mount 40 constrains the movement of flute element 30 in three orthogonal directions. In particular, base portion 42 inhibits travel of flute element 30 in a radially inward direction, backing portion 44 inhibits travel of flute element 30 in the direction opposite the rotation of feed roll 10, and stops 57 and 58 inhibit travel of flute 30 in the directions parallel to the longitudinal axis of feed roll 10. The mating engagement of lugs 54A and 54B in recesses 34A and 34B provides additional constraint on the movement of flute element 30 relative to mount 40.

The butting of inner face 32 of flute element 30 against outer face 52 of mount 40, which is provided by the mating engagement of flute element 30 in seat 46 of mount 40, provides a connection for transmitting radially-directed forces acting on flute element 30 though mount 40 to cylindrical body 20. Registration of boreholes 48A, 48B and 48C through mount 40 with corresponding boreholes 38A, 38B and 38C through flute element 30 is not affected by variations in the relative spatial arrangement of mount 40 and cylindrical body 20. As a result, there is no need to oversize the boreholes defined in mount 40 (or flute element 30) in order to both assure registration of boreholes 48A, 48B and 48C with boreholes 38A, 38B and 38C and provide force transmission from flute element 30 to cylindrical body 20.

Though omitted from the drawings so as not to obscure the disclosure, flute 30 may be detachably connected to mount 40 using bolts through boreholes 48A, 48B and 48C and boreholes 38A, 38B and 38C. Threads may be provided in boreholes 38A, 38B, 38C, 48A, 48B and 48C, and the threads formed in corresponding boreholes (i.e., those that are registered when flute element 30 is matingly engaged with mount 40) may be continuous. Alternatively, the threads in corresponding boreholes may be matched so that even if the thread is not continuous a single threaded bolt will mate in the registered boreholes of flute element 30 and mount 40 when flute element 30 is matingly engaged with seat 46 of mount 40. In some embodiment, threads are provided only in boreholes 48A, 48B, and 48C.

Serrated teeth 70 are provided along the outer arcuate edge 72 of flute element 30. Teeth 70, which may have their leading and trailing edges beveled, provide traction against logs fed into feed roller 10. The teeth are preferably progressively larger in depth and width from the inner end of 77 of each flute insert element to the wider outer end 78. In the illustrated embodiment, teeth 70 comprise high chromium steel, and are joined to plate body 31 by thermal brazing. In other embodiments, traction elements other than serrated teeth, such as conical spikes or carbide hardfacing, for example, may be used.

It will be noted that the flute assemblies 26R-26L are positioned relative to the outer flutes 24R-24L so that the outer ends of the mounts are generally aligned with the inner ends of the outer flutes. The flute elements are made sufficiently wider than the mounts to expose the teeth radially outward beyond the outer edge 62 of the mated mount.

It will be appreciated that the complementary right-sided flute elements and mounts are mirror images of the left-sided flute elements and mounts described above. The mounts 40 are positioned so that their inner and outer ends 66, 64 are displaced with respect to one another circumferentially of the roll as seen, for example, in FIG. 1.

Where a component is referred to above, unless otherwise indicated, reference to that component (including a reference to "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof.

For example:

Though in the described example embodiments lugs 54A and 54B extend outward from base portion 42 of mount 40, in other embodiments, recesses may be formed in base portion 42 in place of lugs, and complementary lugs provided on flute element 30 in place of recesses 34A and 34B. Other complementary features between based portion 42 of mount 40 and plate body 31 of flute element 30 are also possible.

Though in the drawings flute element 30 is shown as extending traversely beyond mount 40, flute element 30 may be made thinner so as to be flush with mount 40, or thinner still, so as to be recessed relative to mount 40 when matingly engaged in seat 46.

Complementary pairs of mounts 40 may be joined at inner edges 66A, such as by a weld, or may be axially spaced apart as shown.

Mount 40 is illustrated as being made from a single piece, such as by machining or casting, such that base portion 42 is continuous with inner stop 57 and outer stop 58, and all of these elements are of a piece with backing portion 44. In other embodiments, base portion 42 may not be continuous with either or both of inner stop 57 and outer stop 58, and these elements may be separately formed and affixed to backing portion 44.

In the illustrated embodiment, base portion 42, inner stop 57 and outer stop 58 extend the full length, respectively of inner edge 60, inner end 66, and outer end 64. In other embodiments base portion 42 may not extend the full length of inner edge 60, inner stop 57 may not extend the full length of inner end 66, and outer stop 58 may not extend the full length of outer end 64.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

While specific embodiments of the invention have been described and illustrated, such embodiments should be considered illustrative of the invention only and not as limiting the invention as construed in accordance with the accompanying claims.

What is claimed is:

1. A feed roll comprising:

a roll member having a rotary axis and an outer surface;

two complementing sets of flutes fixed on the roll member; wherein each of the sets of flutes comprises:

a set of mounts circumferentially spaced apart around the outer surface of the roll member, each of the mounts comprising an elongated body, the body comprising a base portion having a radially inner edge fixed on the roll member and a backing portion unitary with the base portion, the backing portion extending longitudinally along the base portion and extending radially outward of the base portion along one side of the base portion, the base portion and the backing portion configured to form a seat on a seat side of the mount that is opposed to an opposing side of the mount, the seat extending longitudinally along the mount and defined at least in part by a radially outwardly oriented outer face of the base portion that is spaced radially outwardly from the outer surface of the roll member, and a mounting face of the backing portion extends longitudinally along the mount and extends radially outward of the outer face of the base portion and is oriented substantially perpendicularly thereto, wherein the outer and mounting faces extend substantially in a direction along the length of the mount and the mounting face of the seat of each of the mounts faces the opposing side of an adjacent mount of the set of mounts; and replaceable flute elements detachably and matingly engaged in the seats of corresponding mounts of the set of mounts, each of the replaceable flute elements having a radially inward face engaged against the outer face of the base portion, a backing face engaged against the mounting face of the backing portion and an outer longitudinal edge formed with a traction element for gripping logs, wherein the mounting face of the backing portion and the outer face of the base portion each extend along the full length of the replaceable flute element and the replaceable flute element extends along the length of the seat and radially outward beyond the mount.

2. The feed roll according to claim 1 wherein the outer face of the base portion and the mounting face of the backing portion form an angle of 90 degrees or less.

3. The feed roll according to claim 1 wherein the mounts of the two complementing sets of flutes are arranged in pairs where the mounts of each pair of mounts are arranged in a V-configuration and the seats which receive the replaceable flute elements are on an inside of the V-configuration.

4. The feed roll according to claim 1 wherein in the mounts of each of the sets of mounts the radially inner edge of the base portion has a first arcuate shape and a radially outward edge of the backing portion has a second arcuate shape and the first and second arcuate shapes have different centers such that a radial height of the mount tapers over the length of the mount.

5. The feed roll according to claim 1 wherein in at least some of the mounts of the two complementing sets of flutes the outer face of the base portion is formed to provide one or more lugs that project radially outwardly relative to other parts of the outer face of the base portion and the radially inward face of the corresponding replaceable flute element is formed with one or more recesses configured to engage the one or more lugs.

6. The feed roll according to claim 1 wherein the outer face of the base portion has a convex curvature and the radially inward face of the corresponding flute element has a concave curvature.

7. The feed roll according to claim 1 wherein each mount of the set of mounts comprises:

a first stop at a first end thereof, the first stop bearing against a first end of the corresponding replaceable flute element; and a second stop at a second end thereof, the second stop bearing against a second end of the corresponding replaceable flute element such that the corresponding replaceable flute element is held against moving along the mount by the first and second stops.

8. The feed roll according to claim 7 wherein the first stop comprises a beveled edge that is substantially orthogonal to the rotary axis of the roll member.

9. The feed roll according to claim 1 wherein the seat is configured to support the replaceable flute elements against motion in a radially inward direction and against motion in a direction opposite rotation of the roll member about the rotary axis.

10. The feed roll according to claim 9 wherein the seat is configured to support the replaceable flute elements against motion in an axial direction of the roll member.

11. The feed roll according to claim 1 wherein the base portions constrain the replaceable flute elements against motion in a first direction, and the backing portions constrain the replaceable flute elements against motion in a second direction that is orthogonal to the first direction.

12. The feed roll according to claim 11 wherein the first direction is a radial direction of the roll member.

13. The feed roll according to claim 11 wherein the second direction is a rotational direction of the roll member.

14. The feed roll according to claim 11 wherein the second direction is tangential to the surface of the roll member.

15. The feed roll according to claim 1 wherein the replaceable flute elements each comprise:

a unitary elongated plate body, the radially inward face of the flute element provided by a radially inner longitudinal edge of the plate body, a radially outer longitudinal edge, and the backing face extending between the inner longitudinal edge and the outer longitudinal edge;

the inner longitudinal edge and the backing face being substantially perpendicular to each other for matingly engaging in the seat of the corresponding mount;

and the plate body having a plurality of bolt holes therethrough for passing bolts therethrough to secure the plate body to the corresponding mount.

16. The feed roll according to claim 15 wherein the inner longitudinal edge of the flute element comprises a plurality of spaced apart recesses and the outer face of the base portion comprises a corresponding plurality of lugs that are configured to matingly engage in the recesses.

17. A kit for retrofitting a feed roll, the kit comprising:

a set of mounts, each of the mounts comprising:

an elongated body comprising a base portion having an arcuate radially inner edge configured for attachment to an outer surface of the feed roll; and a backing portion unitary with the base portion that together defines a seat, the backing portion extending longitudinally along the base portion and extending radially outward of the base portion away from the inner edge along one side of the base portion;

the seat extending longitudinally along the mount and defined at least in part by a radially outwardly oriented outer face of the base portion that is opposed to and spaced apart from the inner edge and a mounting face of the backing portion that extends longitudinally along the mount and extends away from the outer face of the base portion and is oriented substantially perpendicularly thereto, wherein the outer and mounting faces extend substantially in a direction along the length of the mount; and a set of complementing replaceable flute elements matingly engageable with the seats of corresponding mounts of the set of mounts, and each of the replaceable flute elements having a radially inward face engageable against the outer face of the base portion of a corresponding one of the mounts, a backing face engageable against the mounting face of the backing portion of the corresponding one of the mounts, and an outer longitudinal edge formed with a traction element for gripping logs, wherein the mounting face of the backing portion and the outer face of the base portion each extend along the full length of the replaceable flute element, and the replaceable flute element, when engaged in the seat of the corresponding one of the mounts, extends along the length of the seat and radially outward from the outer face of the base portion beyond the mounts.

18. The kit according to claim 17 wherein for each mount of the set of mounts the radially inner edge of the base portion has a first arcuate shape and a radially outward edge of the backing portion has a second arcuate shape and the first and second arcuate shapes have different centers such that a radial height of the mount tapers over the length of the mount, and wherein the set of mounts in the kit includes:

a first set of the mounts each of which, when viewed facing the seat the radial height of the mount is greater on a right side of the mount than on a left side of the mount; and a second set of the mounts each of which, when viewed facing the seat the radial height of the mount is greater on the left side of the mount than on the right side of the mount.

* * * * *